United States Patent [19]

Klopfenstein

[11] Patent Number: 4,921,294

[45] Date of Patent: May 1, 1990

[54] SPRING WIRE GRIPPER JAW

[75] Inventor: Andrew L. Klopfenstein, Dayton, Ohio

[73] Assignee: AM International Incorporated, Chicago, Ill.

[21] Appl. No.: 202,837

[22] Filed: Jun. 3, 1988

[51] Int. Cl.[5] ..... B25B 1/06

[52] U.S. Cl. ..... 294/99.1; 271/204; 271/268; 294/104; 198/803.7

[58] Field of Search ..... 271/82, 85, 204, 206, 271/268, 277; 294/104, 99.1; 198/803.7, 803.8

[56] References Cited

U.S. PATENT DOCUMENTS

| | | | |
|---|---|---|---|
| 682,752 | 9/1901 | Saxon . | |
| 1,462,923 | 7/1923 | Stevens | 271/204 |
| 1,861,282 | 5/1932 | Nelson . | |
| 2,619,373 | 11/1952 | Stewart . | |
| 2,775,929 | 1/1957 | Johnson et al. | 294/104 X |
| 4,290,595 | 9/1981 | Thunker | 271/82 X |
| 4,307,801 | 12/1981 | Hansch | 198/803.7 |
| 4,320,894 | 3/1982 | Reist et al. . | |
| 4,381,056 | 4/1983 | Eberie | 294/104 X |
| 4,448,408 | 5/1984 | Faltin | 271/204 X |
| 4,615,555 | 10/1986 | Bateham | 294/104 X |
| 4,638,906 | 1/1987 | Winiasz . | |
| 4,681,213 | 7/1987 | Winiasz . | |
| 4,721,296 | 1/1988 | Mowry . | |
| 4,746,007 | 5/1988 | Houseman | 271/204 X |

FOREIGN PATENT DOCUMENTS

| | | | |
|---|---|---|---|
| 574364 | 4/1976 | Switzerland | 271/204 |

OTHER PUBLICATIONS

IBM Technical Disclosure Bulletin, vol. 15, No. 5, Oct. 1972, Card Gripper for Rotary Press, Hingstman, pp. 1406–1407.

*Primary Examiner*—H. Grant Skaggs
*Assistant Examiner*—W. Waffner
*Attorney, Agent, or Firm*—Tarolli, Sundheim & Covell

[57] ABSTRACT

A gripper assembly for gripping sheet materials such as a folded newspaper includes a fixed jaw and a movable jaw for engaging opposite surfaces of the article. The jaws are supported on a base block for pivotal movement relative to each other. The movable jaw is made of spring wire and includes a pair of gripping tangs, a pair of spring coils associated one with each gripping tang, and a pressing element extending between the gripping tangs. The movable jaw is pivotally mounted on a shaft about which the spring coils are wrapped. The spring coils bias the clamp arm as a whole, and also the gripping tangs, independently of one another, into clamping relation toward the fixed clamp arm. The pressing element clamps and presses the lower folded edge of a folded newspaper being held in the gripper assembly. The movable clamp arm is made from a single continuous piece of spring wire.

14 Claims, 4 Drawing Sheets

SPRING WIRE GRIPPER JAW

BACKGROUND OF THE INVENTION

The present invention relates to a gripper jaw for use in a gripper assembly which is operable between an open position and a closed position to grip an article therein.

Gripper assemblies incorporating gripper jaws are commonly used in conveyor assemblies to convey sheet material articles, such as newspapers or magazines, from one location to another. U.S. Pat. No. 4,638,906 shows a conveyor assembly which includes a plurality of gripper assemblies connected by a conveyor chain. Such a conveyor assembly is shown in U.S. Pat. No. 4,721,296 incorporated into a sheet material handling apparatus, which includes a plurality of pockets for forming sheet material assemblages such as newspapers. The conveyor assembly extends beneath the pockets. A completed sheet material assemblage drops out of a pocket into an open gripper assembly on the conveyor. The gripper assembly then closes about and clamps the sheet material assemblage for transport elsewhere by the conveyor.

U.S. Pat. No. 4,681,213 shows a movable gripper jaw which is pivotable relative to a stationary gripper jaw. The movable gripper jaw has a flat spring steel configuration. Another gripper assembly is shown in U.S. Pat. No. 4,320,894 and includes lower and upper gripper jaws. The upper gripper jaw has a pair of pivotable clamping members which are, independently of one another, pivotable about the shaft upon which they are mounted. The clamping members are spring-biased to a closed position against the lower gripper jaw by a torsion spring mounted on the shaft.

SUMMARY OF THE INVENTION

In accordance with a feature of the present invention there is provided a new and improved gripper jaw for gripping an article such as a folded newspaper. The gripper jaw is made of spring wire and has a pair of gripping tangs to clamp the article against a fixed gripper jaw. The spring wire gripper jaw has a pair of torsion springs associated one with each gripping tang to bias the gripping tangs against the article. The gripping tangs are able to flex and grip independently of each other, to compensate for thickness variations in the article.

In accordance with another feature of the present invention, the spring wire gripper jaw also includes a pressing element which extends between and interconnects the gripping tangs. The pressing element presses against the article at its lower edge to provide additional gripping force. If the article is, for example, a folded newspaper, the pressing element forces air out of the folded edge of the newspaper.

The torsion springs, the gripping tangs, and the pressing element, which together make up the gripper jaw, all comprise a single continuous piece of spring wire.

BRIEF DESCRIPTION OF THE DRAWINGS

The foregoing and other objects and features of the present invention will become more apparent to one skilled in the art upon a consideration of the following description taken in conjunction with the accompanying drawings wherein.

DESCRIPTION OF A PREFERRED EMBODIMENT

The present invention is described herein as being used in a conveyor assembly for conveying sheet material articles such as folded newspapers. It is to be understood, however, that a gripper jaw or gripper assembly as described herein may be useful in other environments, and accordingly the present invention is not limited to use solely in the described environment.

Figure 1:
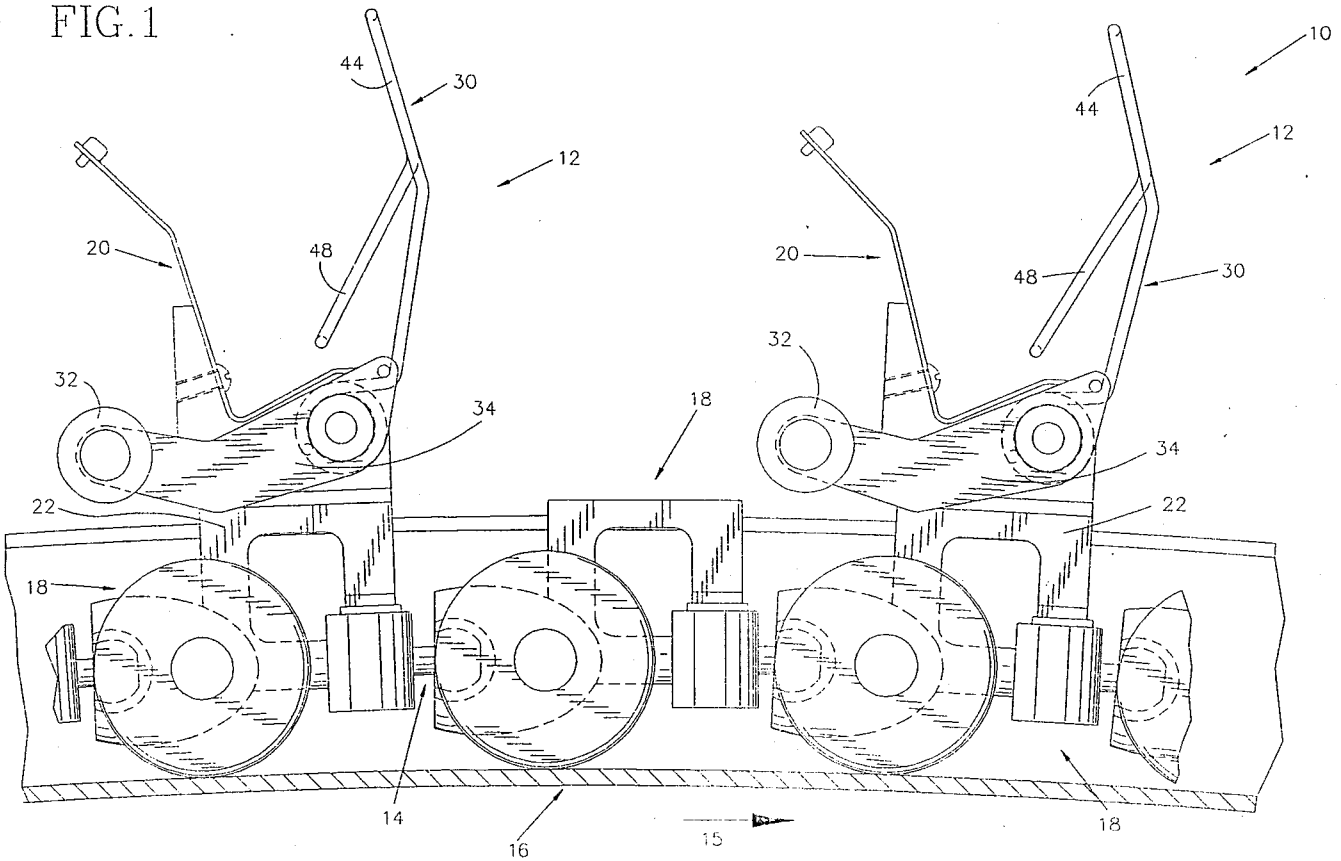
FIG. 1 is an illustration depicting a portion of a conveyor assembly having thereon a plurality of gripper assemblies each incorporating a spring wire gripper jaw in accordance with the present invention.

FIG. 1 illustrates a conveyor assembly 10 which includes a plurality of gripper assemblies 12 each incorporating a gripper jaw 30 in accordance with the present invention. The gripper assemblies 12 are connected to each other by a continuous conveyor chain 14. The conveyor chain 14 is movable in the direction of arrow 15 along a track 16. The track 16 extends from a pick-up station (not shown) to a delivery station (not shown) and then back to the pick-up station. Each gripper assembly 12 is connected to a link 18 in the conveyor chain 14, and is used to grip articles to be transported between the pick-up and delivery stations. Although only three links 18 of the conveyor chain 14 are shown in FIG. 1, it should be understood that a relatively large number of identical links 18 are interconnected to form a continuous conveyor chain 14.

Figure 5:
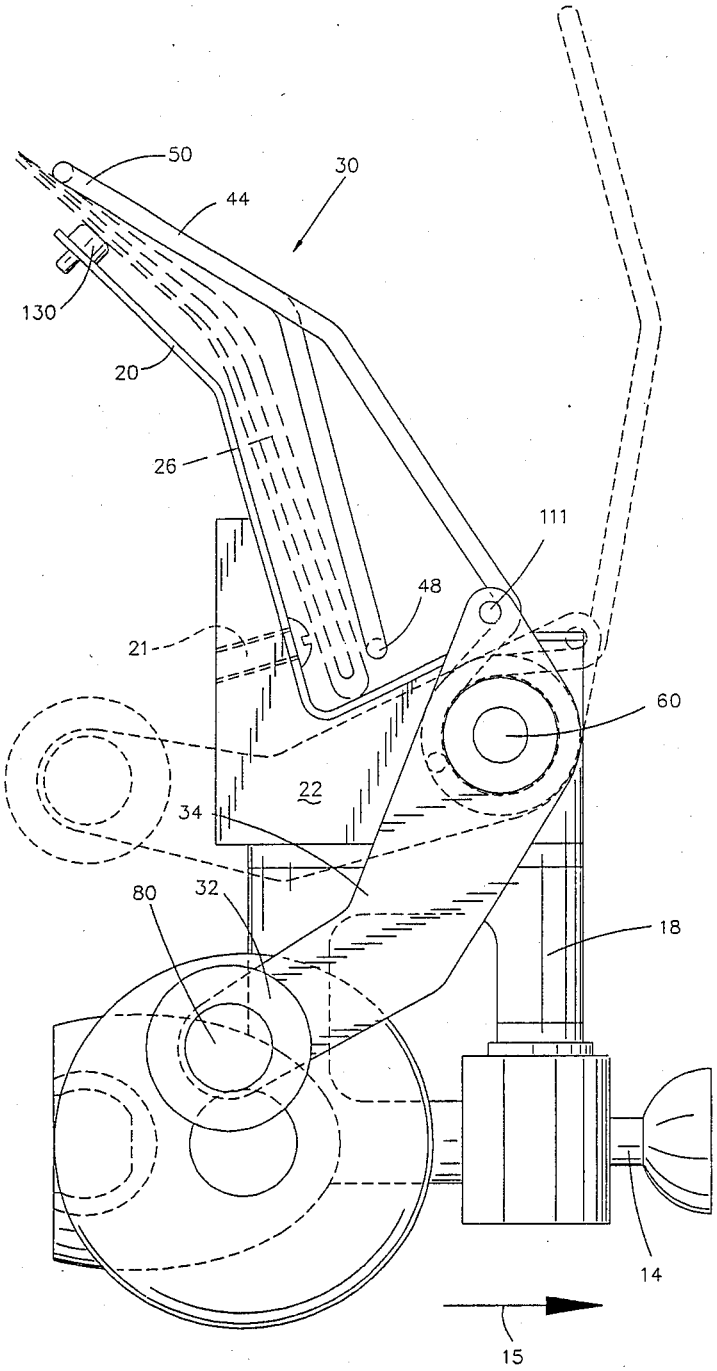
FIG. 5 is a side view of the gripper assembly of FIG. 3 in the closed position and also showing in phantom the gripper jaw in its open position.

Each gripper assembly 12 (FIGS. 1 and 5) includes a stationary jaw 20 secured to a gripper base block 22, and a movable jaw 30 pivotally mounted on the base block 22. The gripper assembly 12 is operable between an open position and a closed position to grip an article therein. FIG. 5 illustrates the gripper assembly 12 in its normally closed position, clamping an article 26 (shown in phantom) such as a newspaper. To open the gripper assembly 12, the movable jaw 30 is pivoted away from the fixed jaw 20, in a clockwise direction as viewed in FIG. 5. Once the article 26 to be clamped has been received in the gripper assembly 12, the movable jaw 30 is pivoted back toward the fixed jaw 20 to clamp the article 26. Such operation will be described in more detail hereafter.

Figure 2:
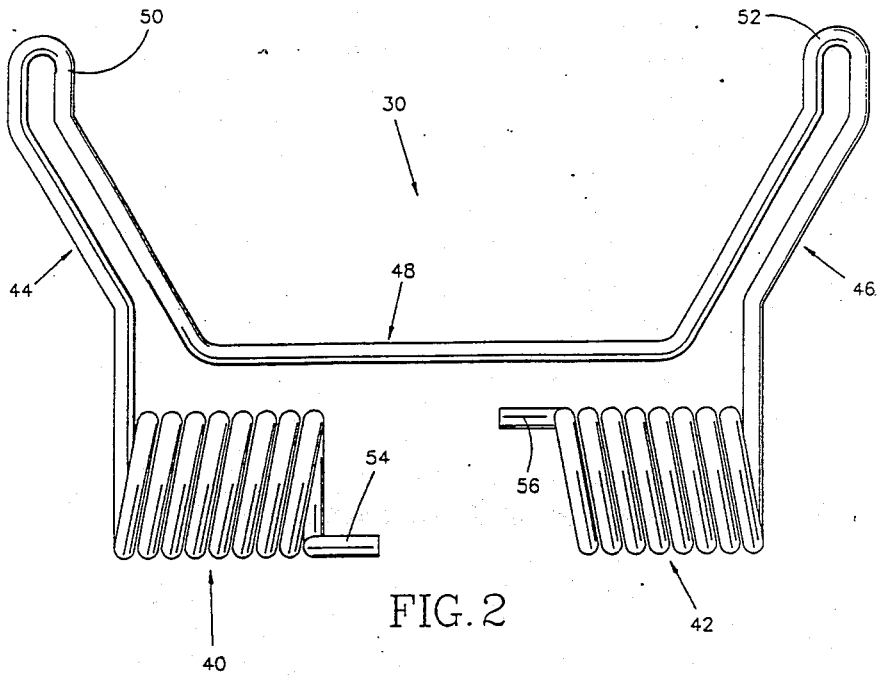
FIG. 2 is a front elevational view showing a gripper jaw in accordance with the present invention.
Figure 3:
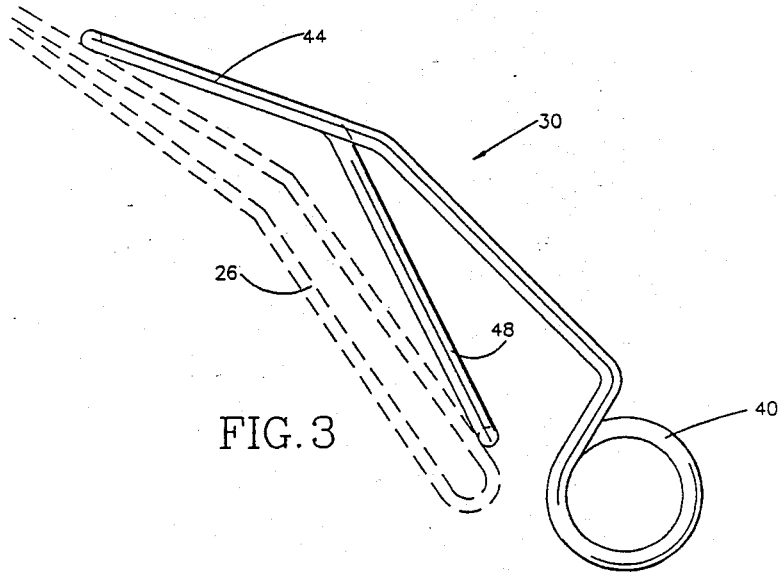
FIG. 3 is a side elevational view of the gripper jaw of FIG. 2.

FIGS. 2 and 3 illustrate in detail the gripper jaw 30. The jaw 30 is formed from wire, and preferably comprises a single continuous piece of spring wire or the equivalent thereof such as two or more pieces of wire joined together to act as one. In a preferred embodiment, the jaw 30 is formed from stainless steel spring wire to minimize corrosion.

The jaw 30 includes a pair of torsion springs 40 and 42, a pair of gripping tangs 44 and 46, and a pressing element 48. The upper portion 50 (about one inch or so) of gripping tang 44, and the corresponding upper portion 52 of gripping tang 46, may be coated with a material such as plastic (not shown) in order to provide a gripping surface which is more suitable for the article being gripped than, for example, bare stainless steel.

Since the jaw 30 is formed from spring wire, the gripping tangs 44 and 46 can flex independently of each other (in the direction toward or away from the viewer of FIG. 2) in order to securely clamp an article 26 which may be of uneven thickness. Also, the pressing element 48 can move independently of the gripping tangs 44 and 46. For example, as best seen in FIG. 3, the pressing element 48 may press the lower (folded) edge of a newspaper 26 deposited in a gripper assembly 12. The pressing element 48 thus provides an extra gripping location in addition to gripping tangs 44 and 46. It also helps to force the air out of the folded edge of the newspaper.

Figure 4:
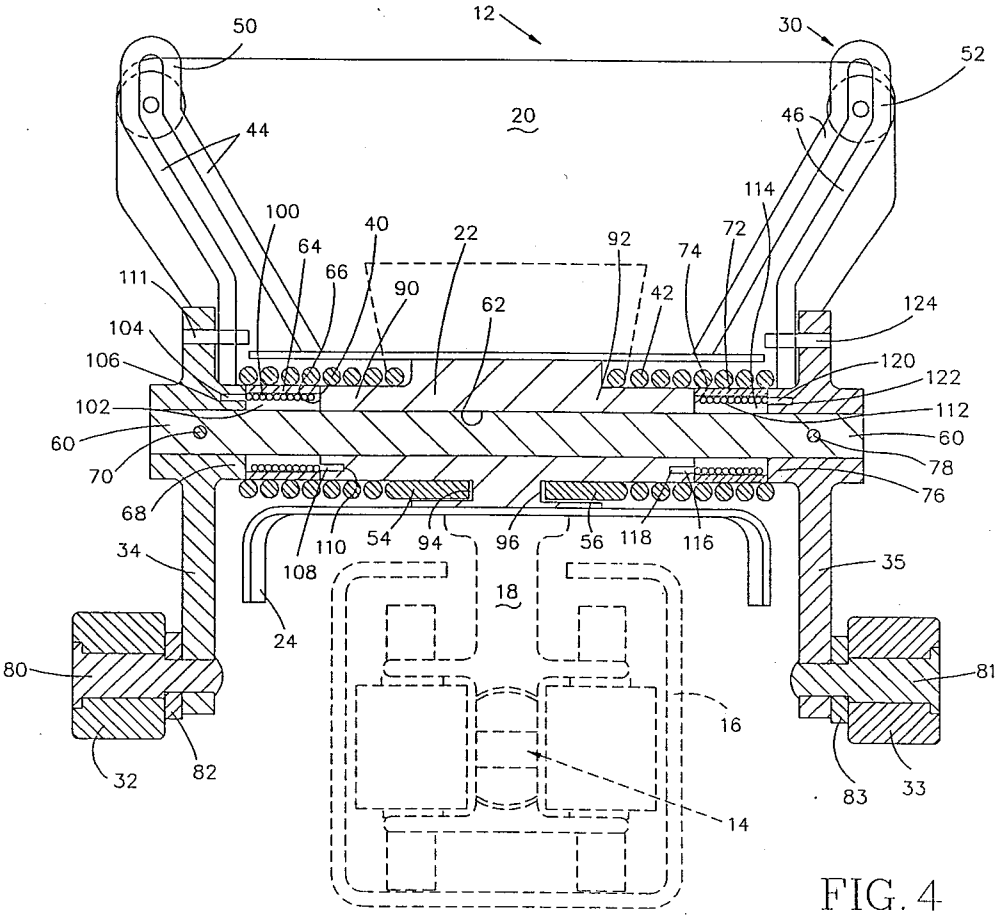
FIG. 4 is a front view, partially in section, of one of the gripper assemblies of FIG. 1.

FIG. 4 illustrates in detail the structure of the gripper assembly 12 which incorporates the gripper jaw 30. The gripper base block 22 is fixed to a chain link 18, with a track shield 24 interposed therebetween. Each chain link 18, as part of conveyor the chain 14, rides within track 16. Thus, as conveyor chain 14 is moved relative to track 16, the base block 22 will be pulled along track 16 also.

The base block 22 has a shaft 60 rotatably received in a bore 62 therein. The shaft 60 is longer than the base block 22 and extends outwardly of the base block 22 at both ends. A pair of actuator arms 34 and 35 are secured at either end of the shaft 60.

A hollow cylindrical spacer 64 is disposed about the shaft 60 between one end 66 of the base block 22 and the actuator arm 34. The actuator arm 34 is secured to shaft 60, with its inner side 68 abutting the spacer 64, by a roll pin 70. Similarly, a hollow cylindrical spacer 72 is disposed between the opposite outer end 74 of the base block 22 and the actuator arm 35. The actuator arm 35 is secured to shaft 60, with its inner side 76 disposed adjacent spacer 72, by a roll pin 78.

The actuator arms 34 and 35 carry cam roller wheels 32 and 33, respectively. Cam roller wheel 32 is journalled on a shaft 80 which is fixed to arm 34. A bushing 82 is disposed between cam roller wheel 32 and actuator arm 34. In a similar manner, cam roller wheel 33 is journalled on a shaft 81 which is fixed to arm 35. A bushing 83 is disposed between cam roller wheel 33 and actuator arm 35.

The gripper jaw 30 (FIG. 4) is mounted for pivotal movement in the gripper assembly 12 by torsion springs 40 and 42. Torsion spring 40 circumscribes the outer end portion 90 of the base block 22, the spacer 64, and the inner portion 68 of actuator arm 34. An end portion 54 of the torsion spring 40 is anchored in a bore 94 in the base block 22. Similarly, the torsion spring 42 circumscribes the outer portion 92 of the base block 22, the spacer 72, and the inner portion 76 of actuator arm 35. An end portion 56 of the torsion spring 42 is anchored in a bore 96 in the base block 22. With gripper jaw 30 so mounted, the gripping tangs 44 and 46 extend generally upwardly and outwardly from the torsion springs 40 and 42 respectively. The pressing element 48 (FIG. 3) connects the gripping tangs 44 and 46.

The torsion springs 40 and 42, with their ends anchored in the base block 22, are wound up so that the gripping tangs 44 and 46 are biased toward the fixed jaw 20, that is, in a counterclockwise direction as seen in FIGS. 1 and 5. Thus, the bias exerted by torsion springs 40 and 42 normally maintains the movable jaw 30 against the fixed jaw 20, and so the gripper assembly 12 is normally in a closed position. In such position, the torsional force exerted by the torsion springs 40 and 42 is strong enough to securely clamp an article 26, such as a newspaper, between the movable jaw 30 and the fixed jaw 20.

The actuator arms 34 and 35 (FIGS. 4 and 5), which move the jaw 30 from its normally closed position to its open position, are biased into engagement with the movable jaw 30. A first actuator spring 100 biases actuator arm 34 against jaw 30, through gripping tang 44. The actuator spring 100 is located within an annular axially extending bore 102 between the shaft 60 and the spacer 64. One end 104 of the actuator spring 100 is anchored in a bore 106 in the actuator arm 34, the other end 108 in a bore 110 in the base block 22. A roll pin 111 is press fitted in the end of actuator arm 34 adjacent to a portion of the gripping tang 44. The actuator spring 100 is wound up so that it exerts a torsional force between the base block 22 and the actuator arm 34 in a direction (clockwise as seen in FIG. 5) as to urge actuator arm 34 and thus roll pin 111 against gripping tang 44. Thus, actuator arm 34 is constantly biased into engagement with the gripping tang 44 and will move therewith.

Similarly, a second actuator spring 112 biases the actuator arm 35 against the gripping tang 46. The actuator spring 112 is located within an annular, axially extending bore 114 between the shaft 60 and the spacer 72. One end 116 of torsion spring 112 is anchored in a bore 118 in the base block 22, the other end in a bore 122 in the actuator arm 35. A roll pin 124 is press fitted in actuator arm 35 adjacent the gripping tang 46. The actuator spring 112 is wound up so that it exerts a torsional force between the base block 22 and the actuator arm 35 in a direction as to urge actuator arm 35, through roll pin 112, against gripping tang 46. Thus, actuator arm 34 is constantly biased into engagement with gripping tang 46 and will move therewith.

Operation

The operation of a gripper assembly 12 will now be described with reference to FIGS. 1 and 5. FIG. 5 illustrates in solid lines the gripper assembly 12 in its closed position; and, in phantom, in the open position. The actuator arms 34 and 35 are normally located with their cam roller wheels 32, 33 disposed low near the plane of conveyor chain 14. FIG. 1 shows a pair of the gripper assemblies 12 in their open position. In each of FIGS. 1 and 5, the gripper assemblies 12 are continuously moved by the conveyor chain 14 in a left-to-right direction in the direction of arrow 15.

When an empty, closed, gripper assembly 12 (FIG. 5) reaches the location along track 16 where it is to pick up an article 26, the cam roller wheels 32 and 33 will engage a pair of fixed cam surfaces (not shown) adjacent to the track 16, which force the cam roller wheels upwardly, until they reach the position shown in phantom in FIG. 5. The actuator arms 34 and 35 are thus pivoted upwardly, and through pins 111 and 124 force the movable gripper jaw 30 into its open position. Although the gripper assembly 12 is operable with only one actuator arm, the preferred embodiment includes a pair of actuator arms to open the gripper assembly evenly, in order to prevent binding of the chain link 18 in the track 16. The gripper assembly 12 may then receive an article 26 such as a folded newspaper for transport elsewhere.

After the article 26 has been deposited into the open gripper assembly 12, the gripper assembly 12 continues moving along the track 16. It will reach a location along the track 16 where the cam surfaces drop off. There will then no longer be any upward force on the cam roller wheels 32 and 33, and so the movable jaw 30 will be returned, by the force of torsion springs 40 and 42, to its closed position as shown in FIG. 5. The actuator arms 34 and 35, and their associated cam roller wheels 32 and 33, will follow and will also return to their original position as shown in solid lines in FIG. 5.

The gripper assembly 12 remains in this closed position, clamping the article 26 therein, until it is transported to a point along the track 16, such as a delivery station, where the article 26 is to be released. When the clamped article 26 is to be released from the gripper assembly 12, the ram roller wheels 32 and 33 will engage further cam surfaces (not shown) to move the actuator arms 34 and 35 and thereby jaw 30 into the open position, in the same manner as when it is being opened to accept an article.

A spring wire gripper jaw 30 in accordance with the present invention has enough spring force to grip an article 26 securely even, for example, when the gripper assembly 12 is turned upside down to allow the article 26 to be dropped therefrom. The end portions 50 and 52 of gripping tangs 44 and 46 may advantageously be coated with a material such as plastic in order to provide a suitable gripping surface. Also, the fixed jaw 20 (FIGS. 4 and 5) preferably includes a pair of bumpers 130 located opposed to the end portions 50 and 52 of the gripping tangs 44 and 46. The bumpers 130 provide a resilient contact between a clamped article 26 and the fixed jaw 20, in order to clamp the article 26 more securely thereagainst. The bumpers 130 may also, if made of a material such as rubber, provide a rough surface which will further help to retain the article 26. A gripper assembly 12 constructed in accordance with the present invention will grip a folded newspaper so strongly that an attempt to pull the newspaper out of the closed gripper assembly will serve only to tear the newspaper.

Assembly

The gripper assembly 12 (FIG. 4) is assembled as follows. Starting with the base block 22, the torsion springs 40 and 42 of jaw 30 are placed over the end portions 90 and 92, respectively, of the base block 22. The spring ends 54 and 56 are inserted into their respective bores 94 and 96 in the base block 22. It should be noted that, although the bores 94 and 96 are shown in FIG. 4 as being spaced angularly 180° apart, they may be located at any appropriate angular orientation around the base block 22, as this location is not critical.

The gripper assembly 12 is next turned on one end, for example on its right hand end as seen in FIG. 4. The actuator spring to be used in the opposite end of the assembly 12, in this case the actuator spring 100, is placed against the end face 66 of base block 22 with its end portion 108 fitted into the bore 110 in the base block 22. The cylindrical spacer 64 is inserted between the actuator spring 100 and the torsion spring 40. Next, the shaft 60, to which the actuator arm 34 has previously been attached with the roll pin 70, is inserted through the center of the actuator spring 100, through bore 62 in base block 22, and outwardly therefrom, until the inner portion 68 of the actuator arm 34 abuts the outer end of spacer 64. The actuator arm 34 is then rotated until the end portion 104 of actuator spring 100 fits into the bore 106 in actuator arm 34.

The gripper assembly is then turned to rest on its opposite end. The actuator spring 112, the spacer 72, and the actuator arm 35 are then assembled in a similar manner, with actuator arm 35 is pinned to the shaft 60 by the roll pin 78. Cam roller wheels 32 and 33 may be attached to actuator arms 34 and 35 at this or any other convenient point in the assembly process.

Next, the wire jaw 30, including torsion springs 40 and 42 whose ends are anchored in the base block 22, is wound up about base block 22 to provide the amount of torsional clamping force desired for gripping tangs 44 and 46. Once this has been achieved, the roll pins 111 and 124 are inserted into the actuator arms 34 and 35 to hold them against the gripping tangs 44 and 46, and the finally fixed jaw 20 is secured to the base block 22 by means of one or more bolts 21 (FIG. 5).

From the foregoing description of a preferred embodiment of the invention, those skilled in the art will perceive improvements, changes and modifications. Such improvements, changes and modifications within the skill of the art are intended to be covered by the appended claims.

I claim:

1. An apparatus for gripping a folded article, comprising first and second jaws for engaging opposite surfaces of the article;

means supporting said first jaw for movement relative to said second jaw; and spring means biasing said first jaw toward said second jaw;

said first jaw having at least one tang for engaging and gripping the article and a pressing element for pressing the fold of the article to force air out of the fold, said pressing element projecting from said one tang toward said spring means;

said first jaw, said pressing element, and said spring means consisting essentially of a single continuous wire.

2. An apparatus as defined in claim 1, wherein said spring means comprises a pair of spaced torsion springs.

3. An apparatus as defined in claim 2 wherein said means supporting said first jaw for movement relative to said second jaw comprises a base member, said second jaw being fixed to said base member and each one of said pair of spaced torsion springs having an end anchored in said base member.

4. An apparatus as defined in claim 3 further comprising actuator means for moving said first jaw away from said second jaw to open said clamp, said actuator means including an actuator arm pivotally attached to said base member;

a cam follower attached to said actuator arm adjacent to a first end thereof;

pin means attached to said actuator arm adjacent to a second end thereof and adjacent to said first jaw; and actuator arm biasing means acting between said actuator arm and said base member for biasing said actuator arm relative to said base member to cause said pin means to engage said first jaw and to bias said first jaw away from said second jaw, the biasing force exerted by said pair of spaced torsion springs being greater than the biasing force exerted by said actuator biasing means.

5. An apparatus as defined in claim 1, wherein said first jaw comprises a pair of spaced gripping tangs.

6. An apparatus as defined in claim 5 wherein said pressing element extends between said pair of spaced gripping tangs and projects from said pair of spaced gripping tangs toward said spring means and is biased by said gripping tangs for engagement with the article.

7. An apparatus as defined in claim 5 wherein said spring means comprises a pair of spaced torsion springs, and wherein said pair of gripping tangs is biased by said pair of torsion springs for engagement with first and second spaced portions of the article.

8. An apparatus as defined in claim 7 wherein said pressing element extends between said pair of spaced gripping tangs and projects from said pair of spaced gripping tangs toward said spring means and is biased by said gripping tangs for engagement with a third portion of the article.

9. An apparatus as defined in claim 8 wherein said first jaw consists essentially of a single continuous piece of spring wire having a first end and a second end and including, in succession therealong from said first end to said second end, one of said pair of torsion springs, one of said pair of gripping tangs, said pressing element, the other of said pair of gripping tangs, and the other of said pair of torsion springs.

10. An apparatus for gripping an article, comprising
a base member;
first and second gripper jaws, said second gripper jaw being fixed to said base member;
means supporting said first jaw for pivotal movement relative to said second jaw between a first position adjacent to said second jaw for gripping the article therebetween, and a second position spaced from said first position and from said second jaw; and
actuator means for moving said first jaw from said first position to said second position;
said first jaw comprising a pair of torsion springs for biasing said first jaw into said first position, two gripping tangs projecting away from said torsion springs for engaging and gripping the article at two spaced apart locations, said two gripping tangs being spaced apart and defining a space between the ends of said gripping tangs in which the article is not engaged by said first jaw when said first jaw engages the article, and a pressing element for pressing the fold of the article to force air out of the fold, said pressing element projecting out of the plane of said gripping tangs from said gripping tangs away from said space toward said torsion springs, said first jaw consisting essentially of a single continuous wire not including the second jaw.

11. An apparatus as defined in claim 10 wherein said first jaw comprises a pair of spaced torsion springs for biasing said first jaw into said first position and a pair of spaced gripping tangs each biased by said pair of torsion springs for engagement with first and second spaced portions of the article.

12. An apparatus as defined in claim 11 wherein said actuator means includes
an actuator arm pivotally attached to said base member;
a cam follower attached to said actuator arm adjacent to a first end thereof;
pin means attached to said actuator arm adjacent to a second arm thereof and adjacent said first jaw; and
actuator arm biasing means acting between said actuator arm and said base member for biasing said actuator arm relative to said base member to cause said pin means to engage said first jaw and to bias said first jaw toward said second position, the biasing force exerted by said torsion springs being greater than the biasing force exerted by said actuator arm biasing means.

13. An apparatus for gripping an article, comprising
a base member,
first and second gripper jaws, said second gripper jaw being fixed to said base member;
said first jaw having at least one tang for engaging and clamping the article against said second jaw, said one tang being pivotally movable about a pivot axis relative to said second jaw between a first position adjacent to said second jaw for gripping the article therebetween, and a second position spaced from said first position and from said second jaw;
spring means for biasing said one tang into said first position; and
actuator means for pivotally moving said one tang against the biasing force of said spring means from said first position to said second position, said actuator means comprising at least one actuator arm which pivots about the pivot axis and extends from the pivot axis and which engages said one tang to move said one tang to the second position;
said first jaw, said gripping tang, and said spring means consisting essentially of a single continuous wire not including said actuator arm.

14. An apparatus as defined in claim 13 further including a pivot shaft carried by said base and pivotal relative thereto, said spring means comprising a torsion spring acting between said base and said one tang, said torsion spring encircling said pivot shaft, and said actuator means comprising an arm fixed to said pivot shaft and having a first portion extending toward said one tang to engage said one tang to move said one tang to its second position.

* * * * *